United States Patent [19]

Templeton

[11] Patent Number: 4,646,830

[45] Date of Patent: Mar. 3, 1987

[54] MECHANICAL JAR

[76] Inventor: Charles A. Templeton, P.O. Box 2566, Odessa, Tex. 79760

[21] Appl. No.: 725,706

[22] Filed: Apr. 22, 1985

[51] Int. Cl.[4] ..... E21B 31/107

[52] U.S. Cl. ..... 166/178; 175/299; 175/304

[58] Field of Search ..... 175/299, 300, 304, 302, 175/293; 166/178, 301; 294/86.23

[56] References Cited

U.S. PATENT DOCUMENTS

| | | | |
|---|---|---|---|
| 1,798,337 | 3/1931 | Newsom | 175/304 |
| 1,885,043 | 10/1932 | Beck | 175/304 |
| 1,895,227 | 1/1933 | McCullough | 175/302 |
| 1,989,907 | 2/1935 | Beck | 175/304 |
| 2,241,477 | 5/1941 | Rasmussen | 175/302 |
| 2,962,098 | 11/1960 | Conrad | 175/304 |
| 3,406,770 | 10/1968 | Arterbury et al. | 175/299 |

*Primary Examiner*—James A. Leppink
*Assistant Examiner*—Hoang C. Dang
*Attorney, Agent, or Firm*—Marcus L. Bates

[57] ABSTRACT

A mechanical jar having a variable diameter tension ring which can be reciprocated from a large into a small diameter chamber and vice versa. When a fishing tool is connected to the jar, the jar is run downhole and set down, and a mandrel retracts into a barrel, causing a collet to move the ring into the large diameter chamber whereupon the ring expands to a large diameter and telescopingly receives the collet fingers therewithin. As the jar is picked up, the mandrel moves the ring from the large to the small diameter chamber, thereby reducing the diameter of the ring. This action releasably latches the ring and the collet fingers together. Accordingly, a very large axial force must be applied to the mandrel in order to cause the collet to be released from the ring; and, a very small reverse axial force is required for the collet to latch onto the ring. When the ring releases the collet, the mandrel accelerates a hammer which strikes an anvil with great force, thereby providing uphole thrust on the barrel and on any member which may be attached thereto.

18 Claims, 8 Drawing Figures

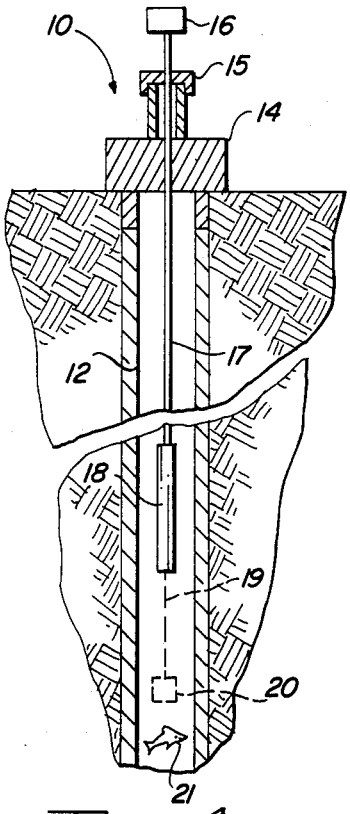
FIG. 1
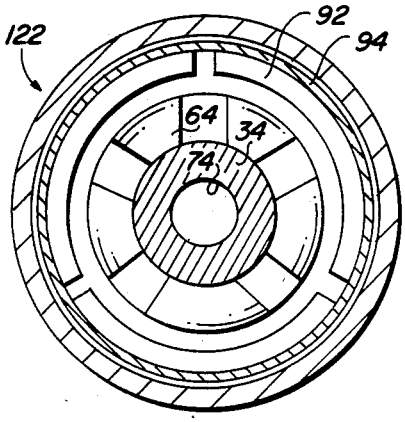
FIG. 7
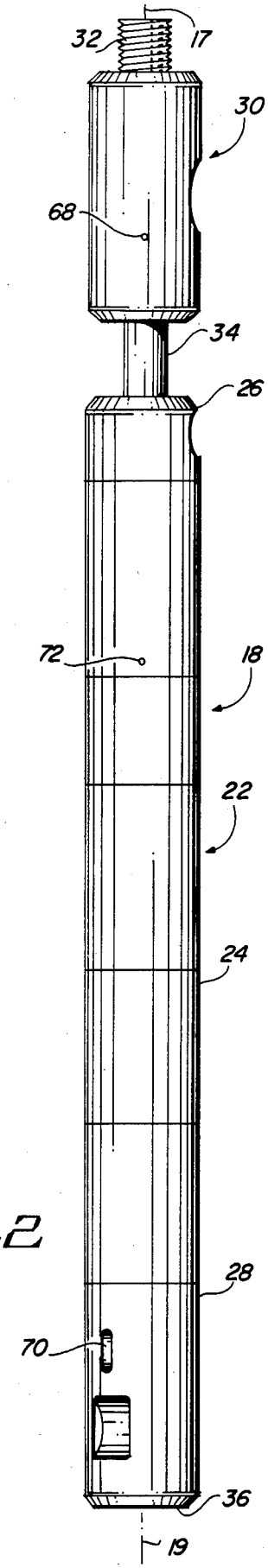
FIG. 2
FIG. 3
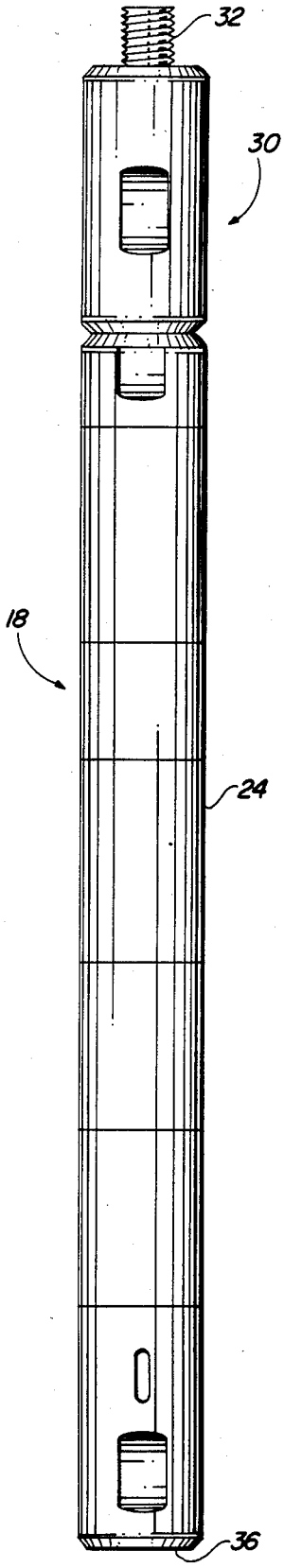

MECHANICAL JAR

BACKGROUND OF THE INVENTION

Mechanical jars are known to those skilled in the art. Mechanical jars are often used for retrieving downhole tools which have become stuck or lodged downhole in a borehole. A jar can be run downhole on the end of a tubing string, drill string, or wireline. The wireline is especially suitable for running a jar for it enables a great force to be stored in the resilient wireline which is exerted on a jar mandrel. This is because there are usually several thousand feet of wire rope connected between the jar socket and the above surface operation. Therefore great energy is stored into a wireline for use in jarring a member uphole.

Both mechanical and hydraulically actuated jars are known to those skilled in the art. Most jars of the mechanical and the hydraulic type are extremely complicated, and for this reason they often malfunction. This often presents a serious problem when working downhole in a borehole.

One should never put anything downhole in a borehole that he is not willing to lose. Some boreholes cost several million dollars. Any tool that is to be run downhole into a borehole is first carefully evaluated and scrutinized by the oil industry. Accordingly, it is desirable that any tool string have incorporated therein a jar so that should any part of the string become stuck downhole, there is a likelihood that the jar can provide sufficient up-thrust to unstick the stuck tool or fish. It is not humorous that the jar which is suppose to obviate a fish often becomes a fish itself, and thereby compounds the problem of the first fish for now there are two fishes to be retrieved from the borehole.

The present invention comprehends a mechanical jar for use downhole in a borehole which stores and releases energy in a unique, novel, and unobvious manner.

SUMMARY OF THE INVENTION

The present invention comprehends method and apparatus for imparting a large axial force into a member by the provision of improvements in a mechanical jar. The mechanical jar of this invention has an axial passageway formed through a main body, with the main body having first, second, and third stop members formed therewithin. A mandrel has a marginal end thereof reciprocatingly received within the axial passageway so that the free end of the mandrel and the other end of the member can be connected in series relationship within a tool string to be used downhole in a borehole.

The first stop means is an anvil. A hammer is formed on the mandrel at a location wherein the hammer impacts against the first stop means when the mandrel is reciprocated in a first direction. The passageway is enlarged into a chamber having a first diameter and a chamber having a second diameter. An expansible ring or sleeve is reciprocatingly received for movement within the small and large diameter chambers; and, the sleeve changes diameter when moved from one to the other chamber. The sleeve is captured between the second and third spaced stop means, which define the length of the two chambers.

A collet is affixed to the mandrel at a location wherein the free end of the collet can be made to pass into the tension sleeve and thereby releasably latch onto the sleeve.

When the mandrel is telescoped further into the main body, the collet pushes the sleeve from the small into the large diameter chamber, causing the sleeve to expand, whereupon the collet easily enters the sleeve and latches thereto. When the mandrel is moved in the opposite direction, the collet moves the sleeve into the small diameter chamber whereupon the sleeve reduces in diameter, and thereby increases the tension force required for the collet to be released from the sleeve.

Accordingly, when the jar is connected in series relationship respective to a tool string, and the jar is run downhole and set down, the mandrel telescopes into the main body, thereby moving the sleeve into the large diameter chamber and latching the collet onto the sleeve. When the tool is picked up, the mandrel moves the collet, the sleeve moves into the small diameter chamber, and thereby increases the required tension necessary to effect release between the collet and the sleeve. This enables a great predetermined tension force to be stored within the mandrel, and when the holding force afforded by the sleeve is overcome, the collet is suddenly released from the sleeve, the mandrel accelerates respective to the main body, and the hammer strikes the anvil with great force, thereby providing up-thrust and jarring a stuck fish loose.

Accordingly, a primary object of the present invention is the provision of improvements in mechanically actuated jars.

A further object of the present invention is the provision of an improved method of imparting a large uphole thrust into a downhole member.

A still further object of the present invention is to provide an improved mechanical jar having a mandrel which accelerates a hammer in an uphole direction so that the hammer strikes a anvil with great impact and provides a jarring action for unsticking a stuck fish.

Another object of the present invention is the provision of a mechanical jar having a mandrel within which great energy is releasably stored by the provision of a collet on the mandrel which releasably engages a tension sleeve, wherein the sleeve is arranged to change diameter as it moves from a large into a small diameter working chamber, and thereby increases the axial force required for the sleeve to release the collet.

A still further object of the present invention is the provision of a mechanical jar having a hammer attached to a mandrel, wherein the mandrel is accelerated uphole to thereby impact the hammer against an anvil, wherein the mandrel is releasably attached to a tension ring, and wherein the tension ring releasably captures the mandrel with a small force when the mandrel is in one position and which releasably captures the mandrel with a large force when the mandrel is in an alternate position.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIG. 1 is a fragmentary, part diagrammatical, part schematical, part cross-sectional view of a borehole having a tool string located therein, and which illustrates the use of a jar made in accordance with the present invention;

FIG. 2 is an enlarged, side elevational view of a tool made in accordance with the present invention;

FIG. 3 shows the tool of FIG. 2 in an alternate configuration;

FIG. 7 is a cross-sectional view taken along line 7—7 of FIG. 6; and,

DETAILED DESCRIPTION OF THE PREFERRED EMBODIMENTS

Figure 4:
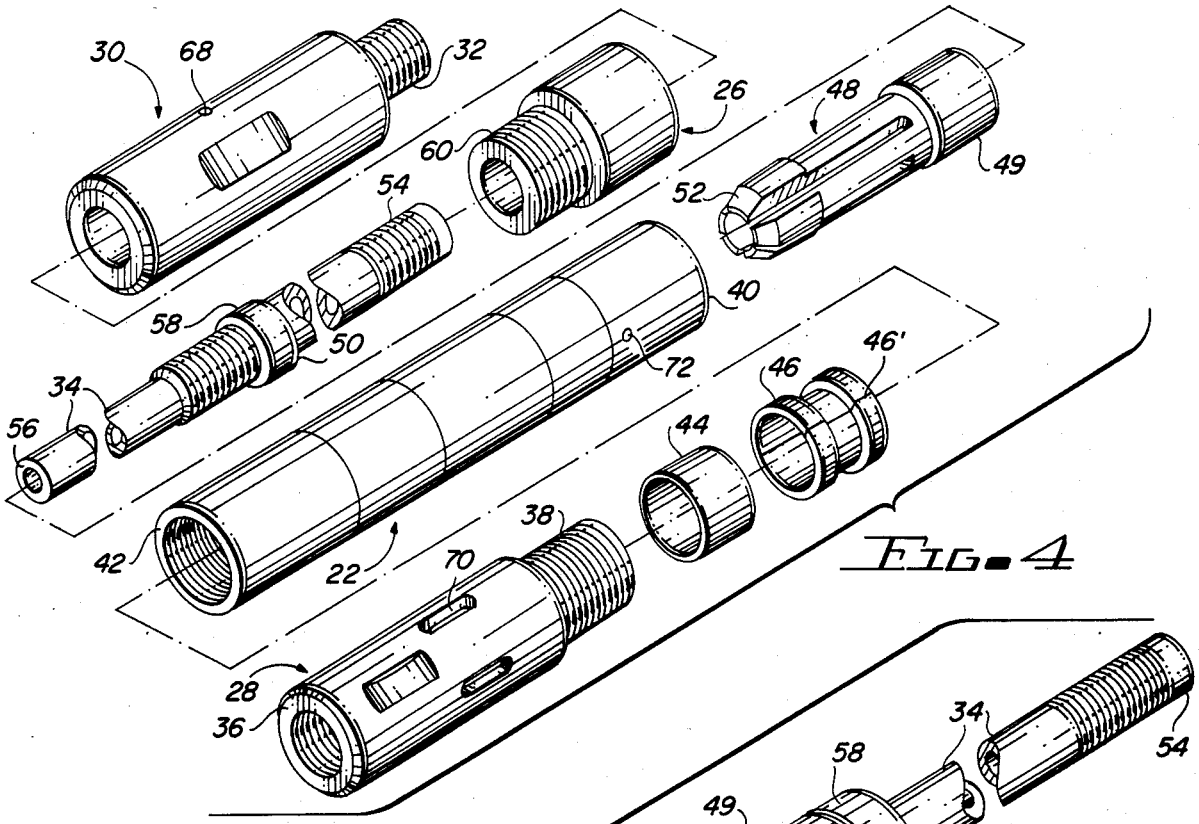
FIG. 4 is an exploded view of the tool previously seen disclosed in FIGS. 2 and 3.

In FIG. 1 of the drawings, there is disclosed a borehole operation 10 being performed in accordance with the present invention. A cased borehole 12 has the usual wellhead 14 at the upper terminal end thereof. A lubricator 15 is attached to the wellhead. Workover apparatus 16, such as a workover rig, supports and controls a wireline or slick line 17 which is attached to one end of a mechanical jar 18, made in accordance with the present invention. The other end of the mechanical jar 18 is attached to a tool string 19, which in turn is attached to a fishing tool 20. A fish 21 is located downhole in the borehole 12. The fish 21 is symbolic of anything lodged downhole which must be retrieved, such as a stuck perforating gun, for example.

In FIG. 2, together with other figures of the drawings there is disclosed further details of the before mentioned mechanical jar 18 of this invention. The jar 18 includes a main body 22 having an outer barrel 24, with there being an impact anvil 26 at one end thereof and a lower sub 28 at the other end thereof.

An upper mandrel connection 30 has threads 32 formed at the pin end thereof by which the jar can be attached to the before mentioned slick line 17. The mandrel connection 30 is affixed to one end of a mandrel 34. Numeral 36 indicates the lower end of the jar, which preferably includes a box formed therein by which the jar can be threadedly connected to the before mentioned tool string 19.

In FIG. 4, together with other figures of the drawings, there is disclosed additional details of the jar 18 of the present invention. As particularly seen illustrated in FIG. 4, the lower sub 28 has a threaded end 38 by which the lower sub threadedly engages the lower threaded end 42 of the barrel 22. The other end 40 of the barrel 22 is similarly threaded for receiving threaded end 60 of the impact anvil 26.

Within the barrel 22, there is reciprocatingly received in a slidable manner an annular spacer 44, which preferably is a continuous cylinder of metal. Adjacent to the spacer 44 is a tension sleeve means 46 made in accordance with this invention. The sleeve means 46 preferably is of annular construction and of a configuration whereby the tension sleeve can increase and decrease in effective diameter. This variation in sleeve diameter is achieved by splitting the tension sleeve into at least one segment as noted at 46'. A tension collet 48, the details of which are more fully disclosed in other figures of the drawings, is positioned adjacent to the tension sleeve 46.

Figure 5:
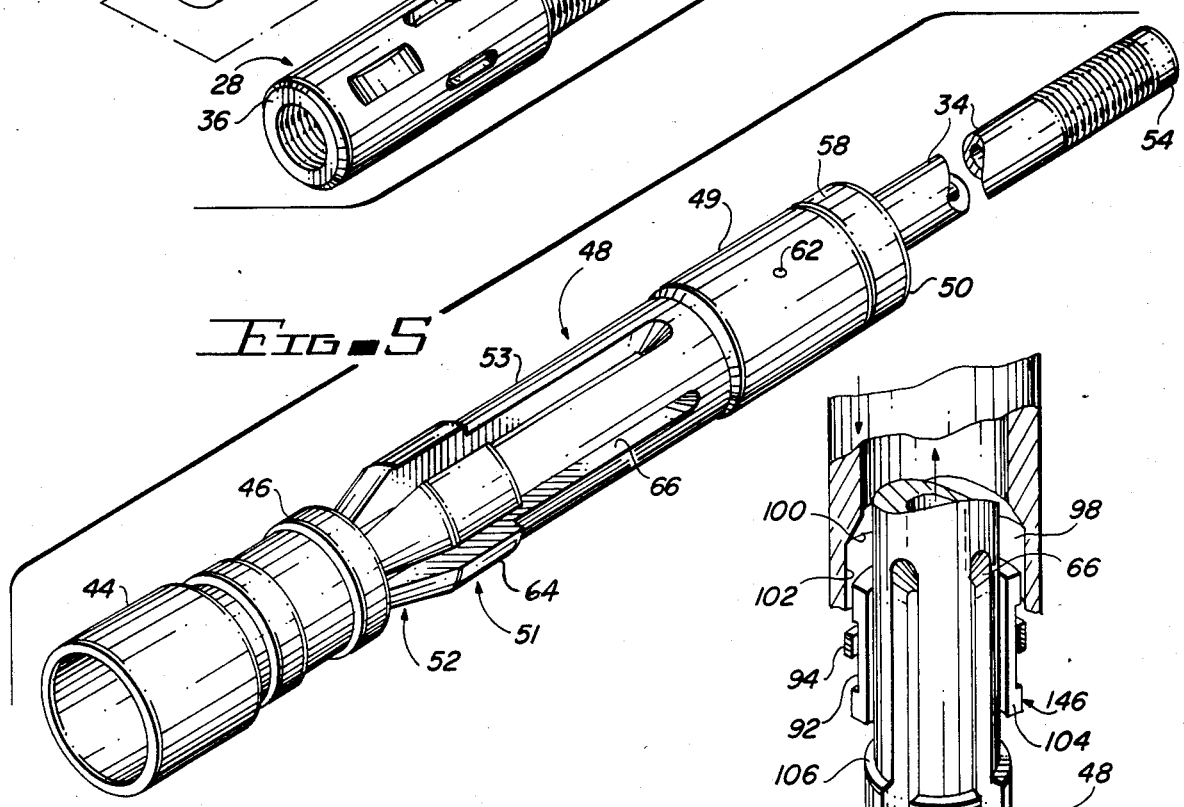
FIG. 5 is a perspective view of an assembled tool such as seen disclosed in the previous figures.

As seen in FIG. 5, together with other figures of the drawings, the tension collet 48 has an upper cylindrical part 49 of annular construction, and is attached to a hammer 58 having an upper face 50 for impacting against the anvil 26. The free end 52 of the collet is provided with an enlargement 51. A medial length of the tension collet is reduced in diameter at 53, thereby forming a latch means in the form of a shoulder which latches onto the sleeve means 46.

Looking again now to FIG. 4, it will be noted that the mandrel 34 has a threaded end 54 by which it is affixed to the upper mandrel connection 30. Numeral 56 indicates the opposed end of the mandrel. The continuous cylindrical part 49 of the tension collet 48 is preferably of annular construction and is reduced in diameter at 53. The end 58 is formed into a hammer having a face 50.

As seen in various figures of the drawings, the impact anvil 26 has the before mentioned threaded end 60 which threadedly engages the box formed at 40 within the outer marginal end of the barrel 22. An anchor pin hole 62 is formed through the collet 48 for rigidly affixing the collet to a marginal lower length of the mandrel 34. The collet 48 includes a plurality of circumferentially extending, flexible, collet fingers 64 formed by the confronting sidewalls 66 of the adjacent fingers. The fingers are made integral with respect to annular part 49. The upper mandrel connection 30 has an anchor pin hole 68 formed therethrough for rigidly affixing the mandrel connection 30 to a marginal terminal end of the mandrel. Radial slots 70 are formed through the lower sub 28 so that fluid can flow therethrough as may be required. Weep holes 72 are formed through a sidewall of the barrel for fluid flow therethrough.

Figure 6:
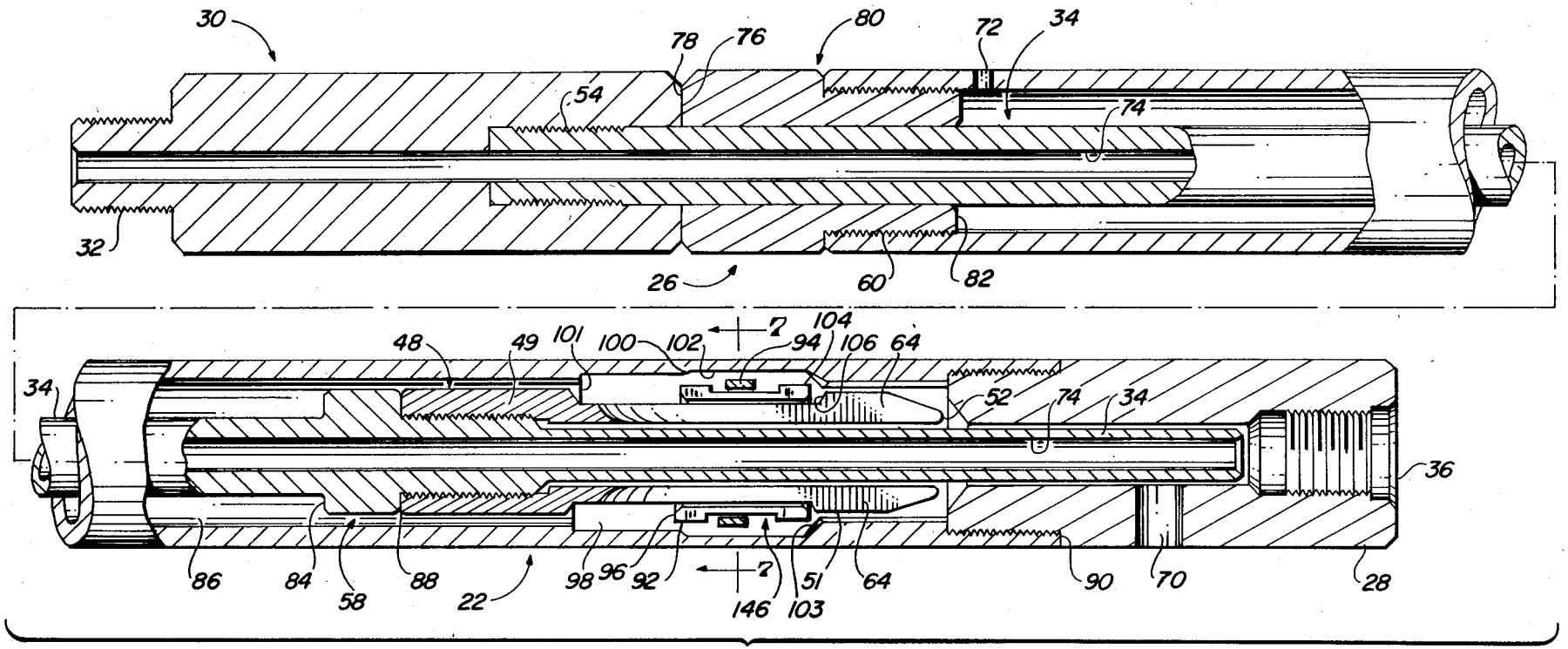
FIG. 6 is an enlarged, longitudinal, part cross-sectional view of the tool disclosed in the foregoing figures.

In FIG. 6, together with other figures of the drawings, wherein like or similar numerals refer to like or similar elements, a central, longitudinally extending passageway 74 is formed through the entire jar device so that electrical conductors and the like can be extended from the wireline 17, through the jar, and down to a tool string 19. The upper mandrel connection 30 includes a shoulder 76 for abuttingly engaging a shoulder 78 formed on the impact anvil 26 so that the jar can be actuated for achieving a "jarring down" action of a magnitude which is smaller than the impact achieved when "jarring up". Numeral 80 indicates the interface formed between the impact anvil and the barrel. Numeral 82 indicates a circumferentially extending face formed on the impact anvil which abuttingly engages a similar circumferentially extending face 84 formed on the hammer 58.

A working chamber 86 is provided within the barrel for allowing proper reciprocation of the hammer 58. Numeral 88 indicates an interface formed between the fixed end of the tension collet 48 and the hammer 58. Numeral 90 indicates an interface formed between the lower sub 28 and the outer barrel 22.

Figure 8:
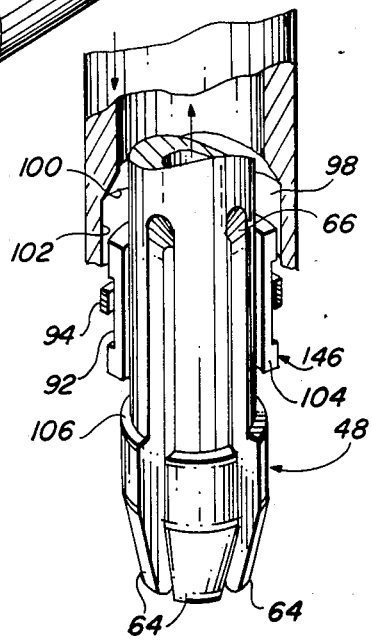
FIG. 8 is a fragmentary view of part of the apparatus seen disclosed in FIG. 6.

The tension sleeve means 46 of FIGS. 4 and 5 comprises an annular cylinder which is interrupted at one location by a longitudinal cut 92 formed through the sidewall thereof, which enables the discontinuous annular sleeve means to be changed in diameter when the confronting edges formed by the longitudinal cut are forced towards and away from one another. The tension sleeve means can alternatively be made of a plurality of segments 92, as seen in FIGS. 6 and 8, which are assembled to provide an annular member 146 which expands radially. Each of the segments 92 have opposed faces 104 which abuttingly engages one another when the tension sleeve is in the small diameter configuration, and which are spaced from one another when the tension sleeve is in the increased diameter configuration. A retainer ring 94 is received within the illustrated groove formed about the outer surface of the segments 92, and maintain the segments integrated into an annular configuration. The uphole end 96 of the tension sleeve forms a circumferentially extending shoulder which is moved by the collet into abutting engagement with respect to a shoulder 101 which defines one end of a working chamber 98. The working chamber 98 is defined by the spaced, opposed, confronting shoulders 101 and 103 which present stop means for alternately abuttingly engaging the opposed shoulders of the tension sleeve. The working chamber 98 is divided into a relatively large diameter part spaced from a relatively small diameter part by the inclined surface 100. The inclined surface 100 preferably is inclined at 30° and can be made any angle up to about 60°, and for that matter, the entire chamber can be made conical, that is, a frustum of a cone, in configuration.

The mechanical jar of the present invention therefore is provided with means at opposed ends 32 and 36 thereof, by which the jar can be connected into a tool string. The jar can be connected into the tool string with either end 32 and 36 looking uphole. The jar includes a mandrel having a hammer and a tension collet formed thereon in axially spaced relationship respective to one another. The hammer is positioned to be reciprocated into abutting relationship with respect to a first stop means disclosed herein as an impact anvil. The collet has a free end having latch means formed thereon for latching onto a tension sleeve. The tension sleeve can be reciprocated from a large into a small diameter chamber and vice versa, which causes the sleeve to change in diameter. When the tool is set down, the collet forces the tension sleeve to reciprocate into the large diameter part of the working chamber, thereby increasing the diameter of the tension sleeve so that the free end of the collet is easily radially compressed so that it passes through the tension sleeve, whereupon the collet fingers expand and thereby latch onto the lower shoulder of the tension sleeve. When the tool is picked up, the collet carries the tension sleeve therewith as the tension sleeve reciprocates from the large into the small chamber and engages a second stop member. As the tension sleeve passes from the large into the small diameter chamber, the diameter of the sleeve is reduced so that the force required for the collet to be moved back through the tension sleeve is greatly increased. Accordingly, the slick line, as it is withdrawn from the borehole, stores tremendous energy therewithin. Therefore, as the tension within the mandrel is increased, the force with which the tension sleeve restrains the collet is eventually overcome, whereupon the collet is suddenly released and passes from the arrested tension sleeve. This action accelerates the mandrel uphole until the hammer impacts against the anvil, thereby providing great up-thrust to the barrel of the jar and to any tool string attached thereto.

As the jar is set down, the collet forces the tension sleeve into abutting engagement with a third stop means 103. Hence the tension sleeve reciprocates within a working chamber 98 between the limits 101 and 103 provided by the second and third stop means. The working chamber diverges in diameter so that the tension sleeve likewise must change in diameter as it moves along the length of the chamber 98. The effective change in diameter of the tension sleeve changes the force that must be applied to the mandrel in order to withdraw the collet fingers from the sleeve means. The design of the collet provides a latch means at the lower sleeve shoulder and the shoulder 106 which is formed between the large and small diameter parts of the collet. The design of the shoulder 106, the design of the lower shoulder of the tension sleeve, the inside diameter of the tension sleeve, and the diameter of the working chamber all contribute a combination which determines the tension that must be applied to the mandrel in order for the collet to be withdrawn from the sleeve.

The sleeve can be provided with an internal shoulder of circular configuration which is engaged by the collet fingers at 106 in lieu of engagement of the fingers with the lower sleeve shoulder. The split sleeve means 46 of FIGS. 4 and 5 is preferred because there is a shoulder at each opposed end thereof, which enables reversal of the sleeve when one shoulder becomes worn.

In operation, the jar of the present invention is connected to a tubing string, drill string, slick line, or wireline 17. The jar of the present invention is connected in series relationship respective to a tool string 19, which usually will include a fishing tool 20 for retrieving a fish 21 located in the lower borehole.

As the wireline 17 is run downhole, the fishing tool 20 engages the fish 21. The wireline 17 is then retrieved, withdrawing the fishing tool along with the tool string 19 from the borehole, and the stuck fish 21 causes great tension to be imparted into the wireline 17, thereby storing energy therein. As the workover rig 16 further increases the tension within wireline 17, a force magnitude is reached within the tension sleeve which releases the collet, or vice versa, thereby accelerating the hammer towards the anvil, whereupon the hammer strikes the anvil with great force and the resultant impact causes the fish to become unstuck.

I claim:

1. A mechanical jar for imparting a large axial force into a member, comprising:

an outer barrel having a sub formed at one end thereof and an impact anvil at the other end thereof; an axial passageway formed through said barrel, sub, and impact anvil;

a mandrel having a free end extending from said barrel and a marginal end reciprocatingly received within the passageway of said barrel, another sub formed at said free end of said mandrel, a tension collet formed at the marginal end of said mandrel that is received within the barrel; a hammer formed on the marginal end of said mandrel that is located within the barrel;

means forming a collet working chamber within said barrel, said working chamber forms part of the axial passageway, said working chamber has spaced shoulders; an expandable tension sleeve means reciprocatingly received within said working chamber, said sleeve means has opposed ends which can be moved into abutting engagement with said shoulders, a marginal length of said working chamber adjacent the outer barrel is of a relatively large inside diameter and the marginal length of the working chamber adjacent the impact anvil is of a relatively small diameter;

said sleeve means has an outside diameter respective to the inside diameter of the working chamber to cause the sleeve means to slidably engage the wall surface of the working chamber and thereby be reduced in diameter as the sleeve means moves from the large into the small diameter part of the working chamber;

said collet includes a plurality of elongated fingers, each of said elongated fingers having a free end which extends from a fixed end, said fingers are circumferentially positioned about the longitudinal axis of the working chamber and are biased radially outwardly into engagement with the interior of the sleeve means whereby the free end of the fingers can be deformably forced through the interior of the tension sleeve means;

a shoulder formed on the exterior of said fingers, a shoulder formed on said sleeve means; whereby, when the mandrel is telescoped into the barrel, the free end of the fingers moves the sleeve means into abutting engagement respective to one shoulder of said working chamber, whereupon, the fingers of the collet pass into the sleeve means, and when the mandrel is reciprocated in a direction away from the barrel, the shoulder on the fingers engages the shoulder on the sleeve means and the collet moves the sleeve means into the small diameter part of the chamber and into engagement with another shoulder, whereupon the sleeve means reduces in diameter and thereby increases the required tension in the mandrel in order for the collet to be released from the sleeve means, whereupon the mandrel then accelerates as the hammer travels in a direction to impact against the anvil.

2. The jar of claim 1 wherein said mandrel and collet have a central passageway formed .therethrough through which an electrical conductor can be extended longitudinally through the entire jar.

3. The jar of claim 1 wherein said sleeve means is of annular configuration and has a central axis which coincides with the central axis of the barrel; said sleeve means is split along a plane which lies along the central longitudinal axis thereof to thereby render the sleeve means deformable radially.

4. The jar of claim 1 wherein means are provided by which said another sub abuttingly engages a stop means when the mandrel is moved in the other direction so that the jar can be used to generate a large impact force in one direction and a smaller impact force in another direction.

5. The jar of claim 1 wherein said mandrel and collet have a central passageway formed therethrough through which an electrical conductor can be extended longitudinally through the entire jar;

said sleeve means is annular in configuration and has a central axis which coincides with the central axis of the barrel; said sleeve means is split along a plane which lies along the central axis thereof.

6. The jar of claim 1 wherein said sleeve means is made of a plurality of segments which jointly form a segmented cylinder, spring means by which said segments are radially biased towards one another and thereby assume a relatively small diameter when the collet is spaced therefrom and which assumes a relatively large diameter as the collet is forced thereinto.

7. The apparatus of claim 1 wherein said collet is in the form of a cylinder having longitudinally extending slots formed at one marginal end thereof which provide said fingers, the other end of the cylinder being attached to the end of the mandrel adjacent to the hammer.

8. A jar having a main body, an elongated passageway formed through said main body;

said passageway is reduced in diameter to form spaced apart first, second, and third stop means;

a mandrel having a marginal end reciprocatingly received within said passageway and an opposed free marginal end which extends away from said main body, a hammer means formed on said mandril at a location which abuttingly engages said first stop means to provide a jarring action;

an expandable tension sleeve means reciprocatingly received within said passageway at a location between said second and third stop means, said sleeve means has a shoulder formed thereon;

a collet affixed to said mandrel, said collet has a free marginal end in the form of a plurality of circumferentially spaced fingers, said collet has a large diameter marginal end which can be forced into the sleeve means, a shoulder formed on said collet for engaging said shoulder formed on the sleeve means; each of said fingers are biased radially outwardly and each of said fingers include a leading free end of a size to be received within the tension sleeve means;

means by which one end of the mandrel and one end of the main body can be series connected into a tool string;

whereby movement of the mandrel into the main body forces the sleeve means to move into engagement with the third stop means and into the part of the passageway located between the second and third stop means, whereupon the large diameter marginal end of the collet passes into the sleeve means, and subsequent movement of the mandrel away from the main body forces the sleeve means to move into engagement with the second stop means and into the part of the passageway located between the first and second stop means thereby holding the mandrel until sufficient tension has been applied to the mandrel to cause the collet to be released from the sleeve means, so that the mandrel can accelerate until the hammer strikes the first stop means.

9. The jar of claim 8 wherein said mandrel and collet have a central passageway formed therethrough through which an electrical conductor can be extended longitudinally through the entire jar.

10. The jar of claim 8 wherein said sleeve means is annular in configuration and has a central axis which coincides with the central axis of the barrel; said sleeve means is split along a plane which lies along the central axis thereof.

11. The jar of claim 8 wherein said means at one end of said mandrel abuttingly engages still another stop means when the mandrel is moved into the main body so that the jar can be used to generate a relatively large impact force in one direction and a relatively smaller impact force in another direction.

12. The jar of claim 11 wherein said mandrel and collet have a central passageway formed therethrough through which an electrical conductor can be extended longitudinally through the central axis of the entire jar;

said sleeve means is annular in configuration and has a central axis which coincides with the central axis of the barrel; said sleeve means is split along a plane which lies along the central axis thereof.

13. The jar of claim 8 wherein said sleeve means is made of a plurality of segments which jointly form a segmented cylinder, spring means by which said segments are radially biased towards one another and thereby assume a relatively small diameter when the sleeve means is moved into the small diameter part of the working chamber, and which assumes a relatively large diameter as the sleeve means is moved into the large diameter working chamber and the collet is forced thereinto.

14. The apparatus of claim 8 wherein said collet is in the form of a cylinder having longitudinally extending slots formed at one marginal end thereof which provide said fingers, the other end of the cylinder being attached to the end of the mandrel adjacent to the hammer.

15. In a mechanical jar for imparting a large axial force into a member, wherein the jar has an outer barrel with a sub formed at one end thereof, and an impact anvil at the other end thereof; an axial passageway formed through said barrel, sub, and impact anvil; and a mandrel having a free end extending from said barrel and a marginal end reciprocatingly received within the passageway of said barrel, there being another sub formed at the free end of the mandrel; the improvement comprising:

means forming a tension collet at the marginal end of said mandrel that is received within the barrel; a hammer formed on the marginal end of said mandrel that is located within the barrel;

means forming a collet working chamber within said barrel, said working chamber forms part of the axial passageway, said working chamber has spaced confronting shoulders; an expandable tension sleeve means reciprocatingly received within said working chamber, said sleeve means has opposed ends which can be moved into abutting engagement with said shoulders, a marginal length of said working chamber adjacent the outer barrel sub is of a relatively large inside diameter and the marginal length of the working chamber adjacent the impact anvil is of a relatively small diameter;

said sleeve means has an outside diameter respective to the inside diameter of the working chamber to cause the sleeve means to slidably engage the wall surface of the working chamber and thereby be reduced in diameter as the sleeve means moves from the large into the small diameter parts of the working chamber;

said collet includes a plurality of elongated fingers, each of said elongated fingers having a free end which extends from a fixed end, said fingers are circumferentially positioned about the longitudinal axis of the working chamber and are biased radially outwardly to enable the fingers to engage the interior of the sleeve means, whereby the free end of the fingers can be deformably forced through the interior of the tension sleeve means;

a shoulder formed on the exterior of said fingers, a shoulder formed on said sleeve means; whereby, when the mandrel is telescoped into the barrel, the free end of the fingers moves the sleeve means into abutting engagement respective to one shoulder of said working chamber, whereupon, the fingers of the collet pass into the sleeve means, and when the mandrel is reciprocated in a direction away from the barrel, the shoulder on the fingers engages the shoulder on the sleeve means and the collet moves the sleeve means into the small diameter part of the chamber and into engagement with the other shoulder, whereupon the sleeve means reduces in diameter and thereby increases the required tension that must be placed on the mandrel in order for the collet to be released from the sleeve means, whereupon the mandrel then accelerates the hammer in a direction to impact against the anvil.

16. The improvement of claim 15 wherein said sleeve means is made of a plurality of segments which jointly form a segmented cylinder, spring means by which said segments are radially biased towards one another and thereby assume a relatively small diameter when the sleeve means is moved into the small diameter part of the working chamber, and which assumes a relatively large diameter as the sleeve means is moved into the large diameter working chamber and the collet is forced thereinto.

17. The improvement of claim 15 wherein said collet is in the form of a cylinder having longitudinally extending slots formed at one marginal end thereof which provide said fingers, the other end of the cylinder being attached to the end of the mandrel adjacent to the hammer.

18. The improvement of claim 15 wherein said mandrel and collet have a central passageway formed therethrough through which an electrical conductor can be extended longitudinally through the entire jar;

said sleeve means is annular in configuration and has a central axis which coincides with the central axis of the barrel; said sleeve means is split along a plane which lies along the central axis thereof.

* * * * *